US005230633A

United States Patent [19]

Hisatomi et al.

[11] Patent Number: 5,230,633

[45] Date of Patent: Jul. 27, 1993

[54] ELECTRICAL CONNECTOR TO BE MOUNTED ON A CIRCUIT BOARD

[75] Inventors: Kazukuni Hisatomi; Osamu Hashiguchi, both of Tokyo, Japan

[73] Assignee: Japan Aviation Electronics Industry, Limited, Japan

[21] Appl. No.: 871,919

[22] Filed: Apr. 22, 1992

[30] Foreign Application Priority Data

Apr. 30, 1991 [JP] Japan ..... 3-38711[U]

[51] Int. Cl.[5] ..... H01R 9/09

[52] U.S. Cl. ..... 439/79; 439/80; 439/567

[58] Field of Search ..... 439/79-81, 439/547, 562, 567

[56] References Cited

U.S. PATENT DOCUMENTS

| | | | |
|---|---|---|---|
| 3,727,169 | 4/1973 | Crane et al. | 439/79 |
| 4,588,854 | 5/1986 | Bailey et al. | 439/567 |
| 4,721,473 | 1/1988 | DelGuidice et al. | 439/79 |
| 4,789,346 | 12/1988 | Frantz | 439/80 |
| 5,085,589 | 2/1992 | Kan | 439/567 |
| 5,112,233 | 5/1992 | Lybrand | 439/79 |
| 5,147,220 | 9/1992 | Lybrand | 439/567 |

*Primary Examiner*—Paula A. Bradley

*Attorney, Agent, or Firm*—Laff, Whitesel, Conte & Saret

[57] ABSTRACT

An electrical connector for a printed circuit board has an insulator base portion with a block at both of its ends. Electroconductive contacts supported by the base portion have a terminal to be connected to a pad on the circuit board. Each block has a guide projection to be inserted into a guide hole on the circuit board. A first elastic portion locks into a hole in the circuit board. The base portion has a second elastic portion for engagement with the circuit board. The top ends of the first and the second elastic engagement portions have the first and the second hook portions, respectively. The first and the second hook portions are elastically restored to engage the first and the second hook portions with the second surface of the circuit board. Alternatively, the electrical connector has a pair of second elastic engagement portions respectively extending to a level which is lower than the bottom of surface of the base portion.

4 Claims, 5 Drawing Sheets

ELECTRICAL CONNECTOR TO BE MOUNTED ON A CIRCUIT BOARD

BACKGROUND OF THE INVENTION

This invention relates to an electrical connector and, in particular, to an electrical connector which is to be mounted on a circuit board and which includes an engaging member for electrically connecting the electrical connector and the circuit board and for mechanically engaging the electrical connector with the circuit board.

A conventional electrical connector comprises an insulator and a plurality of electroconductive contacts fitted into the insulator. The insulator comprises a base portion and a pair of blocks formed at both ends of the base portion. Each of the contacts has a support portion supported by the base portion, a contact portion connected to one end of the support portion, and a terminal portion connected to other end of the support portion. The contact portion outwardly extends from a main surface of the base portion. The terminal portion outwardly extends from a subsidiary surface opposite to the main surface. By means of soldering, the terminal portions of a plurality of the contacts are connected in one-to-one correspondence to a plurality of electroconductive pads formed on one or a first surface of a circuit board.

Each of the blocks has a mounting surface to face the first surface of the circuit board. For brevity of the description, one of the blocks is herein referred to because both of the blocks have a similar structure. The mounting surface is provided with a guide projection and a first engaging member in the vicinity of the guide projection. When the mounting surface is mounted to the first surface of the circuit board, the guide projection is inserted into a guide hole formed on the circuit board. The first engaging member comprises a first elastic engagement portion. When the mounting surface is mounted on the first surface of the circuit board, the first elastic engagement portion is inserted into a locking hole formed on the circuit board. Furthermore, the first elastic engagement portion is provided with a first hook portion at a top end thereof. When the first elastic engagement portion is inserted into the locking hole, the first hook portion is brought into contact with the inner wall of the locking hole. The first elastic engagement portion is then elastically deformed and inserted further. Finally, the first hook portion passes through the locking hole and projects onto other or a second surface of the circuit board to be engaged with the second surface of the circuit board.

As described above, the conventional electrical connector has a pair of the blocks each of which is provided with the guide projection and the first engaging member.

In order to meet a demand for accommodating an increased number of the contacts, the base portion must have an increased size in a longitudinal direction to arrange a large number of the contacts.

However, the base portion having such an increased size tends to be bent in an arcuate curve. In this event, the terminal portions are mounted to the pads on the circuit board with gaps left therebetween. As a result, a soldering process is difficult because of presence of such gaps.

In addition, the circuit board is formed of a thin plate. In cases when the circuit board is bent in an arcuate curve, the terminal portions are mounted to the pads on the circuit board with gaps left therebetween like the above-mentioned case. As a result, the soldering process is difficult because of presence of such gaps.

Even on presence of such gaps, it may be possible to connect the terminal portions and the pads on the circuit board by soldering. However, the soldered portions receive a great load due to a force produced by coupling operation between the contact portions and a mating connector. Due to the load, the terminal portions are removed from the pads at the soldered portions. This brings about a connection failure.

Another type of the conventional electrical connector is disclosed in Japanese Unexamined Utility Model Prepublication No. 19281/1991 or Jitsukai Hei 3-19281.

In this electrical connector, a vacant area with no contacts is interposed in an array of a plurality of contacts equally spaced from one another. An engaging pin is made to pass through the vacant area. The top end of the engaging pin is inserted into an engaging hole formed on a circuit board so as to restore the circuit board from a curved shape into a straight shape.

As described above, this electrical connector can restore the circuit board from a curved shape into a straight shape by the use of the engaging pins. However, the engaging pin must be interposed in the array of the contacts to interrupt the array of the contacts. As a result, it is impossible to arrange a large number of the contacts at a high density.

SUMMARY OF THE INVENTION

It is therefore an object of this invention to provide an electrical connector which is capable of restoring a circuit board or an electrical connector from a curved shape into a straight shape so that the electrical connector and the circuit board are brought into tight contact with each other to reliably connect terminal portions of the electrical connector and pads formed on the circuit board by a soldering process.

It is another object of this invention to provide an electrical connector which is capable of reliably locking the electrical connector to a circuit board.

It is a further object of this invention to provide an engagement structure for an electrical connector, whereby a plurality of contacts can be arranged at a high density without interrupting the array of the contacts and which is capable of locking the electrical connector being brought into tight contact with a circuit board.

According to this invention, there is provided an electrical connector to be mounted on a circuit board, comprising a base portion having a main surface, a pair of blocks located at both ends of the base portion, and an insulator including a plurality of electroconductive contacts supported by the base portion, each of the contacts having a support portion supported by the base portion, a contact portion connected to one end of the support portion and outwardly extending from the main surface, and a terminal portion connected to other end of the support portion and outwardly extending from a subsidiary surface opposite to the main surface to be connected to an electroconductive pad formed on a first surface of the circuit board, each of the blocks protruding at a side opposite to the main surface and having a mounting surface perpendicular to the main surface, the mounting surface being provided with a guide projection to be inserted into a guide hole formed on the circuit board when the block is mounted on the first surface of the circuit board and being provided with a first engaging member formed in the vicinity of the guide projection for insertion into a locking hole formed on the circuit board to be engaged with a second surface of the circuit board opposite to the first surface, the base portion being provided at its intermediate portion with a second engaging member to be extended in front of a peripheral edge surface of the circuit board and engaged with the second surface of the circuit board when the block is mounted on the first surface of the circuit board, the lower portion of the subsidiary surface being brought into contact with the peripheral edge surface of the circuit board when the block is mounted on the first surface of the circuit board.

According to an aspect of this invention, the above-described electrical connector to be mounted on a circuit board is characterized in that the first engaging member has a first elastic engagement portion, the first elastic engagement portion being provided at its top end with a first hook portion, the first hook portion being brought into contact with an inner wall of the locking hole when the first elastic engagement portion is inserted into the locking hole, the first elastic engagement portion being then elastically deformed for further insertion, the first elastic engagement portion being restored after completion of insertion so that the first hook portion is engaged with the second surface of the circuit board.

According to another aspect of this invention, the above-described electrical connector to be mounted on a circuit board is characterized in that the second engaging member has a second elastic engagement portion extending from the base portion to a level lower than the bottom surface of the base portion, the second elastic engagement portion being provided at its top end with a second hook portion, the second hook portion being pushed by the first surface of the circuit board to elastically deform the second elastic engagement portion when the peripheral portion of the circuit board is attached to the mounting surface, the peripheral portion of the circuit board being received between the second hook portion and the bottom surface of the base portion, the second elastic engagement portion being elastically restored after reception of the peripheral portion to engage the second hook portion with the second surface of the circuit board.

According to a further aspect of this invention, the above-described electrical connector to be mounted on a circuit board is characterized in that the second engaging member has a pair of second elastic engagement portions, each of the second elastic engagement portions having one end connected to the base portion, the pair of the second elastic engagement portions respectively extending in different spaces between adjacent ones of the contact portions equally spaced until a level lower than the bottom surface of the base portion, a second hook portion being connected between the top ends of the pair of the second elastic engagement portions, the second hook portion being pushed by the peripheral portion of the circuit board to elastically deform the pair of the second elastic engagement portions when the peripheral portion of the circuit board is attached to the mounting surface, the peripheral portion of the circuit board being received between the second hook portion and the bottom surface of the base portion, the second elastic engagement portions being restored after reception of the peripheral portion to engage the second hook portion with the second surface of the circuit board.

DESCRIPTION OF THE PREFERRED EMBODIMENT

Figure 1:
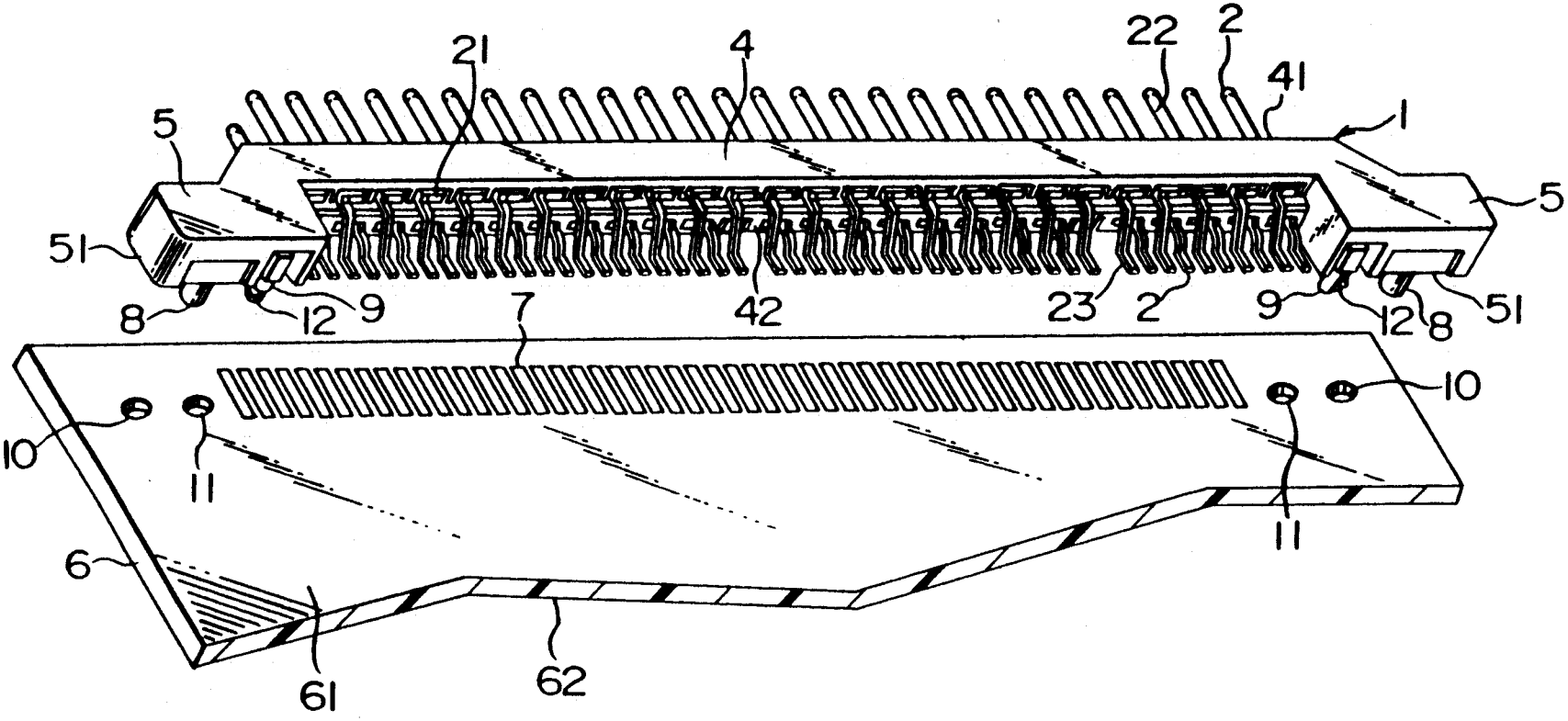
FIG. 1 PRIOR ART
FIG. 1 is a perspective view of a conventional electrical connector and a circuit board for mounting the electrical connector.
Figure 2:
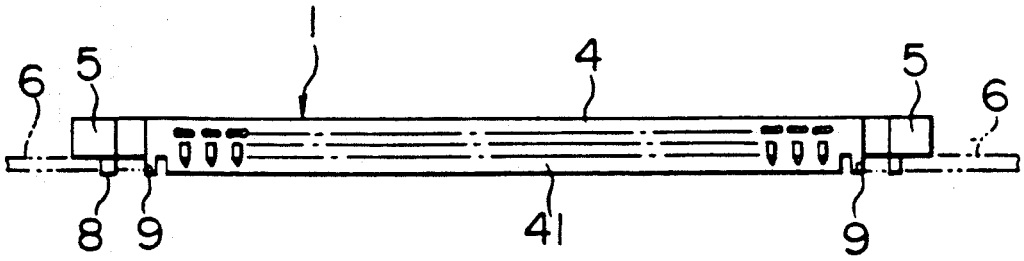
FIG. 2 PRIOR ART
FIG. 2 is a rear view illustrating an insulator of the electrical connector shown in FIG. 1.
Figure 3:
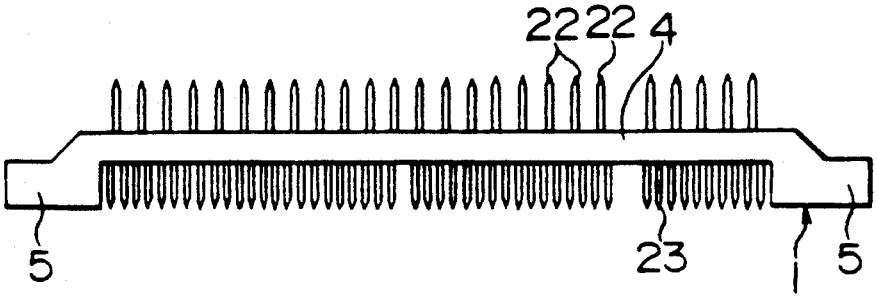
FIG. 3 PRIOR ART
FIG. 3 is a plan view of the electrical connector shown in FIG. 1.
Figure 4:
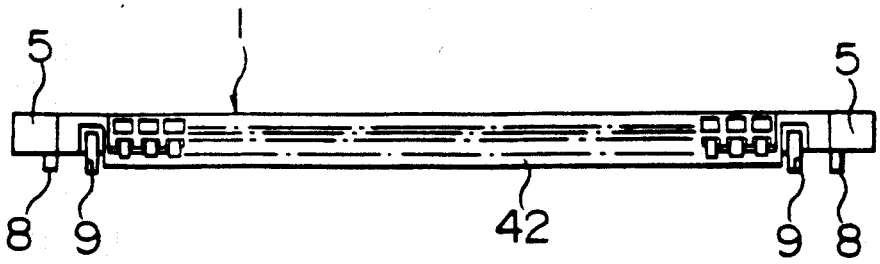
FIG. 4 PRIOR ART
FIG. 4 is a front view illustrating the insulator of the electrical connector shown in FIG. 1.

For a better understanding of this invention, description will at first be made as regards a conventional electrical connector to be mounted on a circuit board with reference to FIGS. 1–6.

As shown in FIGS. 1–4, the conventional electrical connector comprises an insulator 1 and a plurality of electroconductive contacts 2 fitted into the insulator 1. The insulator 1 comprises a base portion 4 and a pair of blocks 5 formed at both longitudinal ends of the base portion 4. Each of the contacts 2 has a support portion 21 supported by the base portion 4, a contact portion 22 of a pin shape connected to one end of the support portion 21, and a terminal portion 23 of a pin shape connected to other end of the support portion 21. Each of the contact portions 22 outwardly extends from a main surface 41 of the base portion 4. The contact portions 22 are arranged in a longitudinal direction of the base portion 4 to form two rows on the main surface 41. Each of the terminal portions 23 outwardly extends from a subsidiary surface 42 opposite to the main surface 41. The terminal portions 23 are arranged in the longitudinal direction of the base portion 4 to form a single row on the subsidiary surface 42. The terminal portions 23 are connected by soldering to electroconductive pads 7 formed on one or a first surface 61 of a circuit board 6 such as a printed circuit board.

Figure 5:
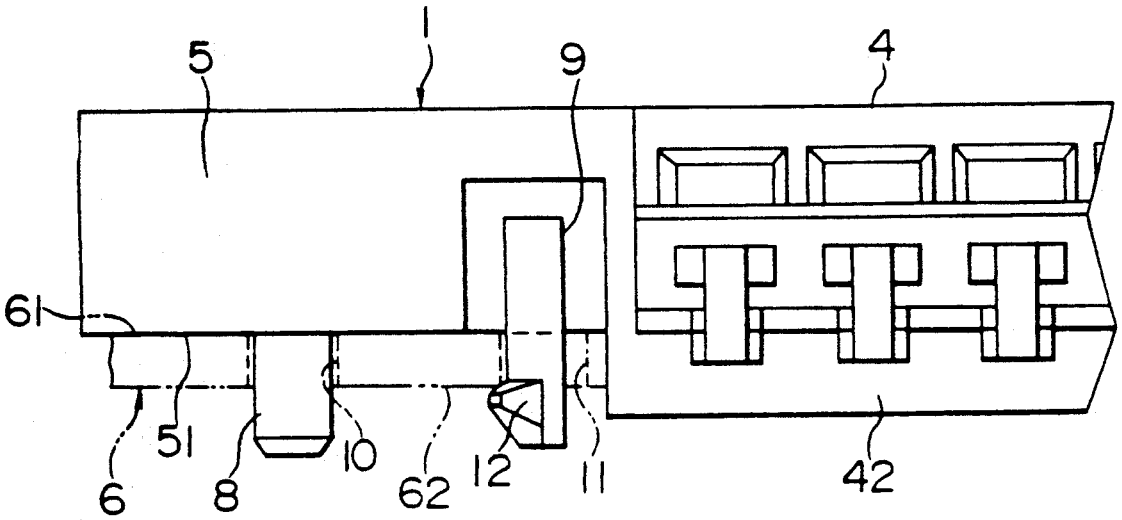
FIG. 5 PRIOR ART
FIG. 5 is a front view of a block portion of the electrical connector shown in FIG. 1.
Figure 6:
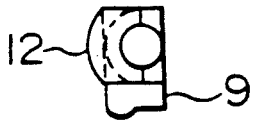
FIG. 6 PRIOR ART
FIG. 6 is a plan view of a first engaging member formed on the block portion of the electrical connector shown in FIG. 1.

Each of the blocks 5 has a mounting surface 51 to be mounted to the first surface 61 of the circuit board 6. As shown in FIGS. 5 and 6 in detail, each of the mounting surfaces 51 is provided with a guide projection 8 and a first engaging member inwardly located in the vicinity of the guide projection 8. A pair of guide holes 10 are formed on the circuit board 6 for receiving the guide projections 8 of both of the blocks 5. For brevity of the description, only one of the blocks 5 will herein be referred to because both of the blocks 5 have a similar structure. The first engaging member has a first elastic engagement portion 9. The guide projection 8 is inserted into the guide hole 10 when the mounting surface 51 is mounted on the first surface 61 of the circuit board 6. A first locking hole 11 is formed on the circuit 5 board 6 to receive the first elastic engagement portion 9. The first elastic engagement portion 9 is inserted into the locking hole 11 when the mounting surface 51 is mounted on the first surface 61 of the circuit board 6.

Furthermore, the first elastic engagement portion 9 is provided at its top end with a first hook portion 12. When the first elastic engagement portion 9 is inserted into the first locking hole 11, the first hook portion 12 is brought into contact with an inner wall of the locking hole 11 to elastically deform the first elastic engagement portion 9 for further insertion. The first hook portion 12 is engaged with another or a second surface 62 of the circuit board 6 after passing through the first locking hole 11.

As described above, the conventional electrical connector has a pair of the blocks 5 each of which is provided with the guide projections 8 and the first engaging member.

As described before, when the base portion 4 has an increased size in, a longitudinal direction, the base portion 4 tends to bend in an arcuate curve. This results in presence of gaps between the terminal portions 23 and the pads 7 formed on the circuit board 6. Accordingly, the soldering process is difficult due to presence of such gaps.

The circuit board 6 having a reduced thickness also tends to be bent in an arcuate curve. This also results in presence of gaps between the terminal portions 23 and the pads 7 formed on the circuit board 6, like the above-mentioned case. Accordingly, the soldering process is difficult due to presence of such gaps.

Even on presence of such gaps, it may be possible to connect the terminal portions 23 and the pads 7 on the circuit board 6 by soldering. However, the soldered portions receive a great load due to a force produced by coupling operation between the contact portions 22 and counterpart contact portions of a mating connector. Due to the load, the terminal portions 23 are removed from the pads at the soldered portion. This brings about a connection failure.

In the engagement structure of another conventional electrical connector described before, it is possible to restore the circuit board from a curved shape into a straight shape by the use of the engaging pin. However, the array of the contacts are interrupted by the engaging pin. It is therefore impossible to arrange a large number of the contacts at a high density.

Now, description will be made as regards as electrical connector according to an embodiment of the present invention with reference to FIGS. 1, 5, 6, and 7 through 13. In the electrical connector of this invention, the similar parts are designated by like reference numerals as described in the conventional example with reference to FIGS. 1, 5, and 6.

Referring to FIGS. 1, 5, 6, and 7 through 11, the illustrated electrical connector to be mounted on a circuit board comprises an insulator 1 and a plurality of electroconductive contracts fitted into the insulator 1. The insulator 1 comprises a base portion 4 and a pair of blocks 5 formed at both longitudinal ends of the base portion 4. The blocks 5 protrude at a side opposite to the main surface 41. Each of the contacts 2 has a support portion 21 supported by the base portion 4, a contact portion 22 of a pin shape connected to one end of the support portion 21, and a terminal portion 23 connected to other end of the support portion 21. The contact portions 22 outwardly extend from the main surface 41 of the base portion 4 and are arranged in a longitudinal direction of the base portion 4. The contact portions 22 are arranged in two rows on the main surface 41. The terminal portions 23 outwardly extend from a subsidiary surface 42 opposite to the main surface 41 and are arranged in the longitudinal direction of the base portion 4. The terminal portions 23 are arranged in a single row on the subsidiary surface 42. The terminal portions 23 are connected by soldering to electro-conductive pads 7 formed on one or a first surface 61 of a circuit board 6 such as a printed circuit board.

Figure 7:
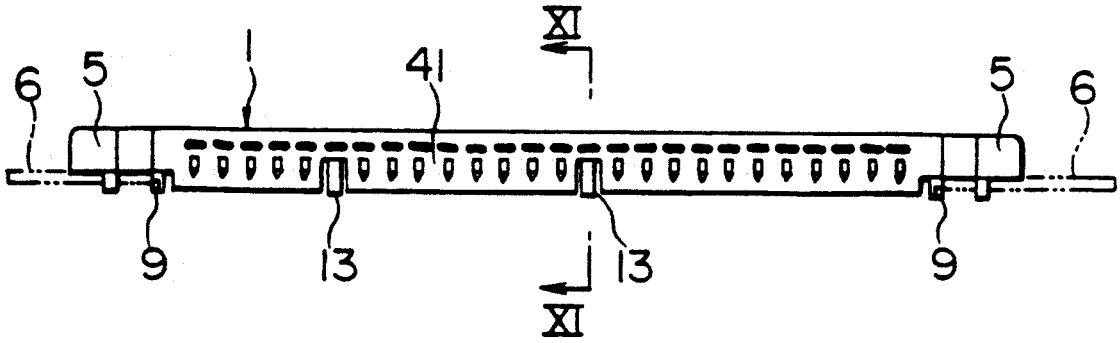
FIG. 7 is a rear view illustrating an electrical connector according to one embodiment of this invention with contacts being omitted therefrom.
Figure 8:
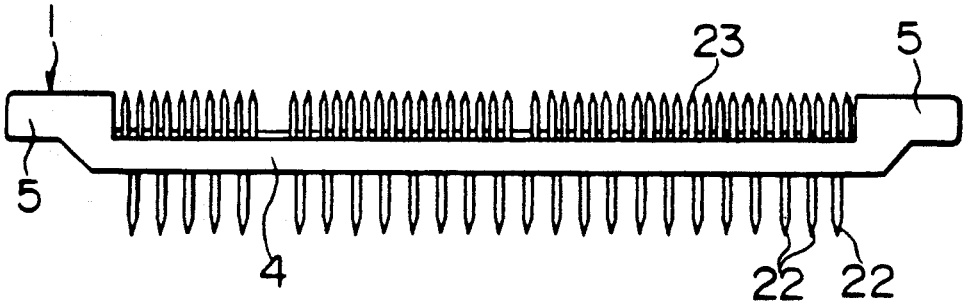
FIG. 8 is a plan view of the electrical connector shown in FIG. 7.
Figure 9:
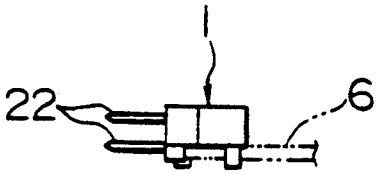
FIG. 9 is a side view of the electrical connector shown in FIG. 7.
Figure 10:
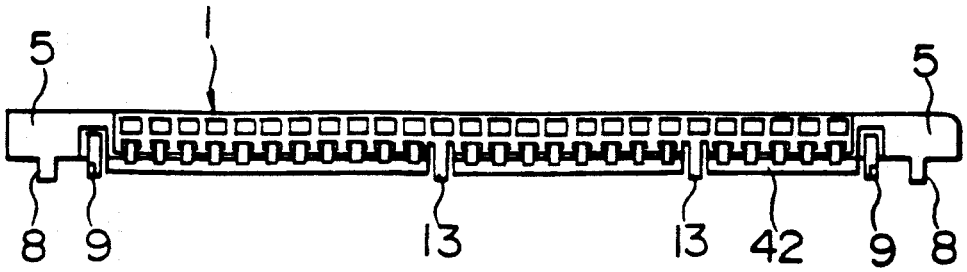
FIG. 10 is a front view illustrating the electrical connector shown in FIG. 7 with contacts being omitted therefrom.
Figure 11:
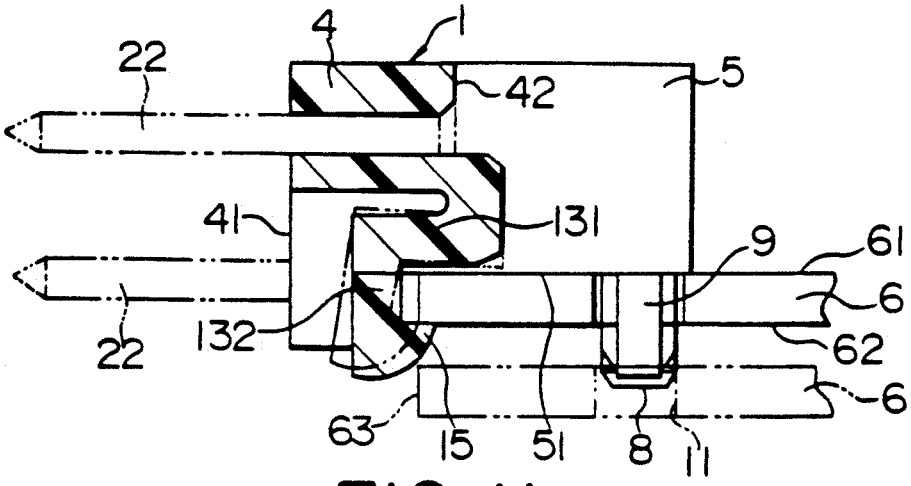
FIG. 11 is a sectional view of the electrical connector shown in FIG. 7 with contacts being omitted therefrom, taken along the line XI—XI.

Each of the blocks 5 has a mounting surface 51 to face the first surface 61 of the circuit board 6. As shown in FIGS. 6 and 7 in detail, each of the mounting surface 51 is provided with a guide projection 8 and a first engaging member inwardly located in the vicinity of the guide projection 8. For brevity of the description, only one of the blocks 5 will herein be referred to because both of the blocks 5 have a similar structure. The first engaging member has a first elastic engagement portion 9. The guide projection 8 is inserted into a guide hole 10 formed on the circuit board 6 when the mounting surface 51 is mounted on the first surface 61 of the circuit board 6. The first elastic engagement portion 9 is inserted into a locking hole 11 formed on the circuit board 6 when the mounting surface 51 is mounted on the first surface 61 of the circuit board 6.

Furthermore, the first elastic engagement portion 9 is provided at its top end with a first hook portion 12. When the first elastic engagement portion 9 is inserted into the first locking hole 11, the first hook portion 12 is brought into contact with an inner wall of the locking hole 11 to elastically deform the first elastic engagement portion 9 for further insertion. The first hook portion 12 is engaged with other or a second surface 62 of the circuit board 6 after passing through the first locking hole 11.

The base portion 4 is provided with a second engaging member at its intermediate portion in the longitudinal direction. The second engaging member has a second elastic engagement portion 13. The second elastic engagement portion 13 has one end connected to the base portion 4 and other end extending to a level lower than the base portion 4. When the block 5 is mounted on the first surface 61 of the circuit board 6, the second elastic engagement portion 13 is extended in front of a peripheral edge surface 63 of the circuit board 6 and is engaged with the second surface 62 of the circuit board 6. More specifically, the second elastic engagement portion 13 comprises a parallel portion 131 having one end connected to the base portion 4 and extending perpendicular to the main surface 41 to face the peripheral portion of the first surface 61 of the circuit board 6, a vertical portion 132 connected to other end of the parallel portion 131 and extending perpendicular to the parallel portion 131, and a second hook portion 15 formed at a top end of the vertical portion 132. When the peripheral portion of the first surface 61 of the circuit board 6 is pressed against the parallel portion 131, the second elastic engagement portion 13 is elastically deformed by the second hook portion 15 to be slightly outwardly opened. When the circuit board 6 is pressed further, the peripheral portion of the circuit board 6 is received between the parallel portion 131 and the second hook portion 15 to engage the second hook portion 15 with the second surface 62 of the circuit board 6.

When the block 5 is mounted on the first surface 61 of the circuit board 6, the lower portion of the subsidiary surface 42 is brought into contact with the peripheral edge surface 63 of the circuit board 6.

Next, description will proceed to operation of mounting the electrical connector to the circuit board 6. At first, the mounting surface 51 of the base portion 4 is faced against the peripheral portion of the first surface 61 of the circuit board 6. At this time, when the guide projection 8 is aligned with the guide hole 10, the first elastic engagement portion 9 is also aligned with the locking hole 11. Simultaneously, the second elastic engagement portion 13 is faced against the peripheral portion of the first surface 61 of the circuit board 6 is pushed towards the second hook portion 12. The second elastic engagement portion 13 is elastically deformed to be slightly outwardly open. The first surface 61 of the circuit board 6 is inserted until it is brought into contact with the parallel portion 131 of the second elastic engagement portion 13. Then, the second hook portion 15 is engaged with the second surface 62 of the circuit board 6. Simultaneously, the first hook portion 12 is engaged with the second surface 62 of the circuit board 6. Thus, locking operation is performed by the first elastic engagement portion 9 and the second elastic engagement portion 13.

Accordingly, even if the base portion 4 of the electrical connector or the circuit board 6 is bent, it is possible by the use of the first and the second elastic engagement portions 9 and 13 to reliably bring the circuit board 6 and the electrical connector into tight contact with each other with the circuit board 6 and the base portion 4 being maintained straight. In this situation, the terminal portions 23 and the pads 7 on the circuit board 6 are brought into contact with each other in one-to-one correspondence therebetween. As a result, the soldering process can be reliably and readily carried out.

In the electrical connector of this embodiment, the array of the equally spaced contact portions 22 of the contact 2 is interrupted by the second elastic engagement portion 13. In order to avoid such interruption, the dimension of the second elastic engagement portion 13 must be decreased. Thus, the second elastic engagement portion 13 can be interposed between the adjacent contact portions 22 so as to avoid interruption of the array of the contact portions 22.

However, the second engagement portion 13 of a decreased size may be weak in strength. In this connection, the electrical connector according to another embodiment has the second engaging member of another structure which will now be described with reference to FIGS. 12 and 13.

Figure 12:
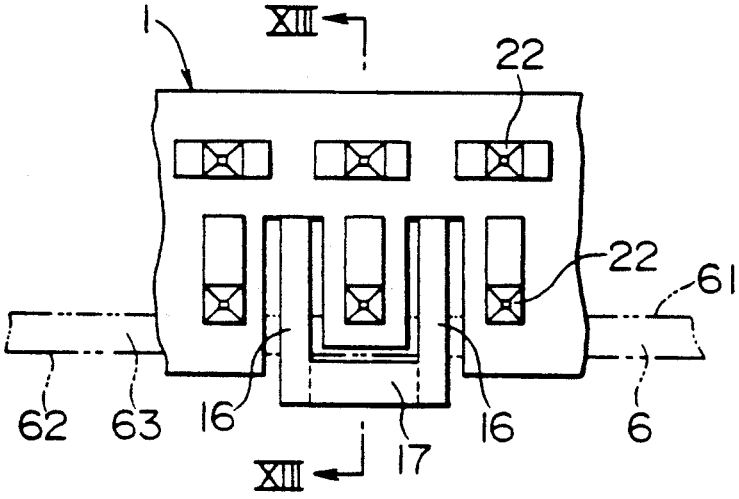
FIG. 12 is a front view for illustrating a second engaging member of an electrical connector according to another embodiment of this invention.
Figure 13:
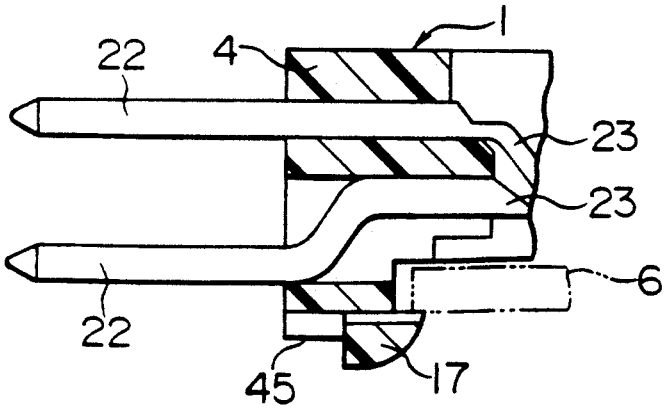
FIG. 13 is a sectional view of the electrical connector shown in FIG. 12, taken along the line XIII—XIII.

Referring to FIGS. 12 and 13, the second engaging member has a pair of second elastic engagement portions 16. One end of each of the second elastic engagement portions 16 is connected to the base portion 4. The pair of the second elastic engagement portions 16 respectively extend in different spaces between the adjacent ones of the equally spaced contact portions 22 until a level lower than the bottom surface 45 of the base portion 4. Top ends of the pair of the second elastic engagement portions 16 are connected to each other through a second hook portion 17. When the peripheral portion of the first surface 61 of the circuit board 6 is pushed against the mounting surface 51, the second elastic engagement portions 16 are elastically deformed by the second hook portion 17 to be slightly outwardly opened so that the peripheral portion of the circuit board 6 is received between the mounting surface 51 and the second hook portion 17. Then, the second hook portion 17 is engaged with the second surface 62 of the circuit board 6.

In the above-mentioned structure, the second elastic engagement portions 16 interposed between the adjacent ones of the contact portions 22 are connected to each other through the second hook portion 17. Accordingly, the second elastic engagement portions 16 are excellent in strength. In addition, the array of the contact portions 22 is not interrupted so that the contacts 2 can be arranged at a high density.

In FIGS. 12 and 13, the pair of the second elastic engagement portions 16 are arranged with only one of the contact portions 22 being interposed therebetween along the direction of the array of the contact portions 22. However, the pair of the second elastic engagement portions 16 may be arranged at an increased distance from each other so that two or more contact portions 22 are interposed therebetween. In this arrangement, the similar effect as mentioned above is obtained. Also in this case, the top ends of the pair of the second elastic engagement portions 16 are connected to each other through the second hook portion 17.

What is claimed is:

1. An electrical connector to be mounted on a circuit board, comprising a base portion having a main surface, a pair of blocks located at both ends of said base portion, and an insulator including a plurality of electroconductive contacts supported by said base portion, each of said contacts having a support portion supported by said base portion, a contact portion connected to one end of said support portion and outwardly extending from said main surface, and a terminal portion connected to other end of said support portion and outwardly extending from a subsidiary surface opposite to said main surface to be connected to an electroconductive pad formed on a first surface of said circuit board, each of said blocks protruding at a side opposite to said main surface and having a mounting surface perpendicular to said main surface, said mounting surface being provided with a guide projection to be inserted into a guide hole formed on said circuit board when said block is mounted on said first surface of said circuit board and being provided with a first engaging member formed in the vicinity of said guide projection for insertion into a locking hole formed on said circuit board to be engaged with a second surface of said circuit board opposite to said first surface, said base portion being provided at its intermediate portion with a second engaging member to be extended in front of a peripheral edge surface of said circuit board and engaged with said second surface of said circuit board when said block is mounted on said first surface of said circuit board, a lower portion of said subsidiary surface being brought into contact with said peripheral edge surface of said circuit board when said block is mounted on said first surface of said circuit board.

2. An electrical connector to be mounted on a circuit board as claimed in claim 1, wherein said first engaging member has a first elastic engagement portion, said first elastic engagement portion being provided at its top end with a first hook portion, said first hook portion being brought into contact with an inner wall of said locking hole when said first elastic engagement portion is inserted into said locking hole, said first elastic engagement portion being then elastically deformed for further insertion, said first elastic engagement portion being restored after completion of insertion so that said first hook portion is engaged with said second surface of said circuit board.

3. An electrical connector to be mounted on a circuit board as claimed in claim 1, wherein said second engaging member has a second elastic engagement portion extending from said base portion to a level lower than the bottom surface of said base portion, said second elastic engagement portion being provided at its top end with a second hook portion, said second hook portion being pushed by said first surface of said circuit board to elastically deform said second elastic engagement portion when said peripheral portion of said circuit board is attached to said mounting surface, said peripheral portion of said circuit board being received between said second hook portion and the bottom surface of said base portion, said second elastic engagement portion being elastically restored after reception of said peripheral portion to engage said second hook portion with said second surface of said circuit board.

4. An electrical connector to be mounted on a circuit board as claimed in claim 1, wherein said second engaging member has a pair of second elastic engagement portions, each of said second elastic engagement portions having one end connected to said base portion, said pair of said second elastic engagement portions respectively extending in different spaces between adjacent ones of said contact portions equally spaced until a level lower than the bottom surface of said base portion, a second hook portion being connected between the top ends of said pair of said second elastic engagement portions, said second hook portion being pushed by said peripheral portion of said circuit board to elastically deform said pair of said second elastic engagement portions when said peripheral portion of said circuit board is attached to said mounting surface, said peripheral portion of said circuit board being received between said second hook portion and the bottom surface of said base portion, said second elastic engagement portions being restored after reception of said peripheral portion to engage said second hook portion with said second surface of said circuit board.

* * * * *